US012703541B2

(12) United States Patent
Bohlig et al.

(10) Patent No.: US 12,703,541 B2
(45) Date of Patent: Aug. 11, 2026

(54) CLOSURE WITH PLUG AND CONTAINER

(71) Applicant: Closure Systems International Inc., Indianapolis, IN (US)

(72) Inventors: Luke R. Bohlig, Hopkins, MN (US); Ryan Konger, Brownsburg, IN (US); Jeremy Morin, Zionsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 8 days.

(21) Appl. No.: 18/820,530

(22) Filed: Aug. 30, 2024

(65) Prior Publication Data

US 2026/0062178 A1 Mar. 5, 2026

(51) Int. Cl.
*B65D 41/04* (2006.01)

(52) U.S. Cl.
CPC ..... *B65D 41/0421* (2013.01); *B65D 2251/20* (2013.01)

(58) Field of Classification Search
CPC ..... B65D 51/1661; B65D 41/0428; B65D 41/0421; B65D 2251/20
See application file for complete search history.

(56) References Cited

U.S. PATENT DOCUMENTS

| | | | | |
|---|---|---|---|---|
| 4,061,240 | A | 12/1977 | Brownbill | |
| 4,210,251 | A | 7/1980 | Grussen | |
| 4,276,989 | A | 7/1981 | Hicks | |
| 4,442,947 | A | 4/1984 | Banich, Sr. | |
| 5,133,471 | A | 7/1992 | Pujol | |
| 5,161,707 | A | 11/1992 | Dutt et al. | |
| 5,769,255 | A | 6/1998 | Ohmi et al. | |
| 5,803,286 | A * | 9/1998 | Pfefferkorn | B65D 51/1661 215/354 |
| 5,871,111 | A | 2/1999 | Pfefferkorn et al. | |
| 6,502,710 | B1 | 1/2003 | Bösl et al. | |

(Continued)

FOREIGN PATENT DOCUMENTS

| | | | |
|---|---|---|---|
| CA | 1196606 | A | 11/1985 |
| CN | 1313233 | A | 9/2001 |

(Continued)

OTHER PUBLICATIONS

Drawing of "Ribbed Top Panel"; allegedly provided at Plastic Cap and Closures North America Conference, Atlanta, Georgia; Sep. 12-14, 2011 (1 page).

(Continued)

*Primary Examiner* — Shawn M Braden
(74) *Attorney, Agent, or Firm* — NIXON PEABODY LLP

(57) ABSTRACT

A polymeric closure includes a first closure portion including a top wall portion and an annular skirt portion. The top wall portion includes polymeric plug seals extending downwardly therefrom. The polymeric plug seals extend around a circumference of the closure with a respective space located between each of the adjacent plug seals. The skirt portion depends from the top wall portion. The annular skirt portion has an interior surface. The interior surface of the skirt portion includes an internal thread formation. The plug seals are spaced from the interior surface of the skirt portion and assist in sealing with a container. The plug seals provide a seal with a finish of the container across at least 40 to about 90 percent of the finish.

27 Claims, 15 Drawing Sheets

(56) References Cited

U.S. PATENT DOCUMENTS

| | | | | |
|---|---|---|---|---|
| 6,695,161 | B2 | 2/2004 | Kano et al. | |
| 6,913,158 | B1 | 7/2005 | Bösl et al. | |
| 7,850,029 | B2 | 12/2010 | Dreyer et al. | |
| 8,066,133 | B2 * | 11/2011 | Takamatsu | B65D 41/0421 215/307 |
| 8,763,830 | B2 | 7/2014 | Sadiq et al. | |
| 9,051,074 | B2 * | 6/2015 | Lonsway | B65D 41/02 |
| 9,254,942 | B2 | 2/2016 | Elliot et al. | |
| 10,308,400 | B2 | 6/2019 | Edie et al. | |
| 10,723,519 | B2 | 7/2020 | Edie et al. | |
| 10,737,846 | B2 | 8/2020 | Tsuzuki et al. | |
| 11,772,582 | B2 * | 10/2023 | Seaman | H02G 15/013 174/152 G |
| 11,851,247 | B2 | 12/2023 | Migas et al. | |
| 2004/0060893 | A1 | 4/2004 | Kano et al. | |
| 2006/0138071 | A1 | 6/2006 | Tsutsumi et al. | |
| 2006/0255003 | A1 | 11/2006 | Fuchs | |
| 2008/0110851 | A1 | 5/2008 | Fuchs et al. | |
| 2011/0024423 | A1 | 2/2011 | Erspamer et al. | |
| 2014/0021157 | A1 * | 1/2014 | Gren | B65D 41/0421 215/252 |
| 2019/0375555 | A1 | 12/2019 | Edie et al. | |
| 2021/0147125 | A1 * | 5/2021 | McNamara | B65D 53/04 |

FOREIGN PATENT DOCUMENTS

| | | | |
|---|---|---|---|
| DE | 3139526 | A1 | 4/1983 |
| EP | 2226264 | A1 | 9/2010 |
| FR | 2863589 | A1 | 6/2005 |
| JP | 58-073551 | A | 5/1983 |
| JP | 2002211605 | A | 7/2002 |
| JP | 2003175948 | A | 6/2003 |
| JP | 2004352360 | A | 12/2004 |
| JP | 2005053580 | A | 3/2005 |
| JP | 2009-208778 | A | 9/2009 |
| JP | 7497873 | B2 | 6/2024 |
| WO | 2007132254 | A1 | 11/2007 |

OTHER PUBLICATIONS

Brochure: "Compression Technology for plastic closures"; SACMI, allegedly published in Oct. 2010 (20 pages).

"Latest developments for CSD Beverages in the field of PCO 1881: Full range of singlepiece closures"; allegedly taken from SACMI presentation at 2011 Packaging Conference, Las Vegas, Nevada; Feb. 7-9, 2011 (1 page).

"Latest Closures Developments in PCO1881"; allegedly from SACMI Open House presentation, Imola, Italy; Mar. 31, 2011 (1 page).

* cited by examiner

CLOSURE WITH PLUG AND CONTAINER

FIELD OF THE INVENTION

The present invention relates generally to a polymeric closure for a package. More specifically, the present invention relates to a polymeric closure with a plug and a container using the same.

BACKGROUND OF THE INVENTION

Polymeric closures have been used in many applications over the years in conjunction with containers. Some current closures used in hot-fill or other applications have problems with mold growth in air pockets between the closure and a container. This air pocket is located between a polymeric plug seal that is sealed with a finish of the container.

It would be desirable to provide a cost-effective polymeric closure that addresses the problems with mold growth within the container, while still performing all of the desirable properties of a polymeric closure.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings and each claim.

According to one aspect of the present disclosure, a polymeric closure comprises a first closure portion including a top wall portion and an annular skirt portion. The top wall portion includes a plurality of polymeric plug seals extending downwardly therefrom. The plurality of polymeric plug seals extends around a circumference of the polymeric closure with a respective space located between each of the adjacent polymeric plug seals. The annular skirt portion depends from the top wall portion. The annular skirt portion has an interior surface. The interior surface of the annular skirt portion includes an internal thread formation for mating engagement with an external thread formation of a container. The plurality of polymeric plug seals is spaced from the interior surface of the annular skirt portion and assists in sealing with the container. The plurality of polymeric plug seals provides a seal with a finish of the container across at least 40 to about 90 percent of the finish.

According to a further configuration of the above implementation, the plurality of polymeric plug seals is from 4 to about 50 plugs. In another embodiment, the plurality of polymeric plug seals is from about 10 to about 40 plugs, or from about 15 to about 30 plugs.

In a further aspect of the above implementation, the plurality of polymeric plug seals is at least 10 plugs.

In a further aspect of the above implementation, the plurality of polymeric plug seals provides a seal with a finish of a container across at least 50 to about 90 percent of the finish. In another embodiment, the plurality of polymeric plug seals provides a seal with a finish of a container across at least 60 to about 80 percent of the finish.

In yet a further aspect of the above implementation, the closure further includes a second closure portion including a tamper-evident band depending from and being partially detachably connected to the annular skirt portion by a first frangible connection.

In a further aspect of the above implementation, the annular skirt portion further includes a second frangible connection that partially detachably connects to a first section and a second section of the annular skirt portion, and a tether is exposed when the first and second frangible connections are broken.

According to a configuration of the above implementation, the polymeric closure is a flip-top closure. The flip-top closure further includes a hinge.

According to a further configuration of the above implementation, the top wall portion further includes an outer seal.

According to a configuration of the above implementation, the polymeric closure is a one-piece closure.

According to another aspect of the present disclosure, a package comprises a container and a polymeric closure. The container has a finish defining an opening. The container has an external thread formation on the finish. The polymeric closure is configured for fitment to the finish of the container for closing the opening of the container. The polymeric closure comprises a first closure portion including a top wall portion and an annular skirt portion. The top wall portion includes a plurality of polymeric plug seals extending downwardly therefrom. The plurality of polymeric plug seals extends around a circumference of the polymeric closure with a respective space located between each of the adjacent polymeric plug seals. The annular skirt portion depends from the top wall portion. The annular skirt portion has an interior surface. The interior surface of the annular skirt portion includes an internal thread formation for mating engagement with the external thread formation of the container. The plurality of polymeric plug seals is spaced from the interior surface of the annular skirt portion and assists in sealing with the container. The plurality of polymeric plug seals provides a seal with the finish of the container across at least 40 to about 90 percent of the finish.

According to a further configuration of the above implementation, the plurality of polymeric plug seals is from 4 to about 50 plugs. In another embodiment, the plurality of polymeric plug seals is from 10 to about 40 plugs.

In a further aspect of the above implementation, the plurality of polymeric plug seals provides a seal with a finish of a container across at least 50 to about 90 percent of the finish. In another embodiment, the plurality of polymeric plug seals provides a seal with a finish of a container across at least 60 to about 80 percent of the finish.

In a further aspect of the above implementation, the closure further includes a second closure portion including a tamper-evident band depending from and being partially detachably connected to the annular skirt portion by a first frangible connection. The annular skirt portion further includes a second frangible connection that partially detachably connects to a first section and a second section of the annular skirt portion, and a tether is exposed when the first and second frangible connections are broken.

In a further aspect of the above implementation, the polymeric closure is a flip-top closure. The flip-top closure further including a hinge.

In a further aspect of the above implementation, the finish of the container has a thickness less than about 0.06 inches.

According to a method of the present disclosure, a package is formed that includes providing a container having a finish defining an opening. The container has an external thread formation on the finish. A polymeric closure is provided that is configured for fitment to the finish of the container for closing the opening of the container. The polymeric closure comprises a first closure portion including a top wall portion and an annular skirt portion. The top wall portion includes a plurality of polymeric plug seals extending downwardly therefrom. The plurality of polymeric plug seals extends around a circumference of the polymeric closure with a respective space located between each of the adjacent polymeric plug seals. The annular skirt portion depends from the top wall portion. The annular skirt portion has an interior surface. The interior surface of the annular skirt portion includes an internal thread formation for mating engagement with the external thread formation of the container. Product is filled into the container in which the product is greater than 150° F. The plurality of polymeric plug seals is placed and spaced from the interior surface of the annular skirt portion and assists in sealing with the container. The plurality of polymeric plug seals provides a seal with the finish of the container across at least 40 to about 90 percent of the finish.

In a further aspect of the above implementation, the product is heated to greater than about 150° F. or greater than about 200° F.

In a further aspect of the above implementation, the product is hot filled at a temperature greater than about 150° F.

In a further aspect of the above implementation, the plurality of polymeric plug seals is from 4 to about 50 plugs.

In a further aspect of the above implementation, the plurality of polymeric plug seals provides a seal with a finish of a container across at least 50 to about 90 percent of the finish.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
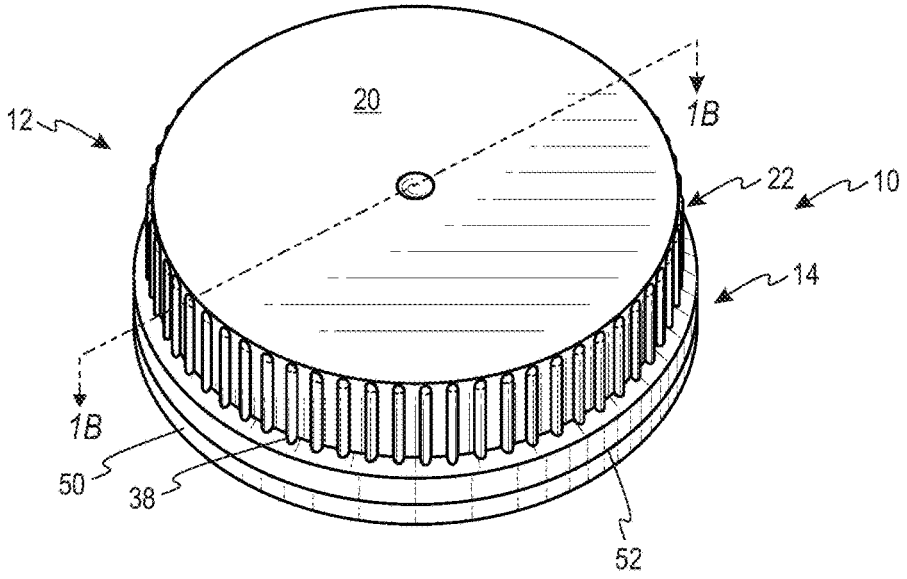
FIG. 1A is a perspective top view of a polymeric closure according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various embodiments are described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The various embodiments are not limited by the illustrated ordering of acts or events, as some acts may occur in different orders and/or concurrently with other acts or events. Furthermore, not all illustrated acts or events are required to implement a methodology in accordance with the present invention.

FIGS. 1A-D illustrate a polymeric closure 10 according to one embodiment of the present invention. The closures are configured to be placed on a container or bottle that contain product. The product is typically a liquid product, but also may be a solid product or a combination of a liquid and solid product. The polymeric closure 10 of FIGS. 1A-1D is a one-piece closure assembly in this embodiment. The polymeric closure 10 is generally cylindrically shaped.

Referring still to FIGS. 1A-1D, the polymeric closure 10 includes a first closure portion 12 and a second closure portion 14. The first closure portion 12 includes a polymeric top wall portion 20, a polymeric annular skirt portion 22 that depends from the polymeric top wall portion 20, a plurality of polymeric plug seals 26*a*, 26*b* (FIG. 1B), a polymeric top seal 28, and a polymeric outer seal 30. In this embodiment, there are exactly two polymeric plug seals. The second closure portion 14 includes a tamper-evident band 50.

The top wall portion 20 extends across the entire top of the polymeric closure 10 without any openings in this embodiment. The plurality of polymeric plug seals 26*a*, 26*b* of FIG. 1B depends from the polymeric top wall portion 20. The plurality of polymeric plug seals 26*a*, 26*b* works in conjunction with an interior surface of a finish of the container to form a seal as will be discussed below in conjunction with FIGS. 2A-2C. The plurality of polymeric plug seals 26 is spaced from an interior surface 22*a* of the polymeric annular skirt portion 22. By being disconnected from the annular skirt portion 22, any impact to an exterior surface 22*b* of the polymeric annular skirt portion 22 will have less risk of being transferred to the finish of the container, which can potentially disturb the seal between the plurality of polymeric plug seals 26*a*, 26*b* and the finish. Such a disturbance can cause a loss in product integrity.

The plurality of polymeric plug seals assists in preventing or inhibiting air pockets from being formed. Any air pocket leaves a potential area for bacteria to remain during, for example, a hot-fill process and then potentially leak into the container once its contents have cooled. The spaces or gaps between adjacent polymeric plug seals of the present invention assist in allowing liquid to freely travel between the polymeric plug seals and the container finish to kill the bacteria during hot-fill or other applications. The plurality of polymeric plug seals of the present invention also assists in maintaining sealing by supporting the finish, which reduces deformation.

In one embodiment, the plurality of polymeric plug seals provides a seal with a finish of a container from at least 40 to about 90 percent of the finish. Thus, the polymeric plug covers at least 40 to about 90 percent of the closure circumference spaced inwardly from the annular skirt portion. In another embodiment, the plurality of polymeric plug seals provides a seal with a finish of a container from at least 50 to about 90 percent of the finish. In a further embodiment, the plurality of polymeric plug seals provides a seal with a finish of a container from at least 60 to about 90 percent of the finish. In a further embodiment, the plurality of polymeric plug seals provides a seal with a finish of a container from at least 60 to about 80 percent of the finish. In yet another embodiment, the plurality of polymeric plug seals provides a seal with a finish of a container from at least 70 to about 90 percent of the finish. In a further embodiment, the plurality of polymeric plug seals provides a seal with a finish of a container from at least 70 to about 80 percent of the finish.

The number of polymeric plug seals is at least 2 polymeric plug seals in one embodiment of a polymeric closure. The number of polymeric plug seals is at least 4 polymeric plug seals in one embodiment of a polymeric closure. In another embodiment, the number of polymeric plug seals is at least 10 polymeric plug seals of a polymeric closure. In a further embodiment, the number of polymeric plug seals is at least 15 polymeric plug seals of a polymeric closure. In yet another embodiment, the number of polymeric plug seals is at least 20 polymeric plug seals of a polymeric closure. Some non-limiting examples of polymeric closures having a different number of polymeric plug seals are shown in FIGS. 3A-5, which are described below.

In one embodiment, the plurality of polymeric plug seals is from about 2 to about 50 plugs. In another embodiment, the plurality of polymeric plug seals is from about 4 to about 50 plugs. In another embodiment, the plurality of polymeric plug seals is from about 8 to about 40 plugs. In a further embodiment, the plurality of polymeric plug seals is from about 10 to about 30 or 40 plugs. In yet another embodiment, the plurality of polymeric plug seals is from about 15 to about 30 plugs.

Referring back to FIG. 1B, the polymeric top seal 28 is shown as being continuous and is in the form of a generally circular ring. The top seal 28 is spaced from and located between the plurality of plug seals 26*a*, 26*b* and the polymeric annular skirt portion 22. The top seal 28 assists in providing a positive stop when the finish of the container and the polymeric closure are being threaded with each other. Thus, the top seal 28 assists in positioning the finish of the container when the polymeric closure is being threaded onto the finish. The polymeric top seal 28 forms an extended seal of the polymeric closure 10. The extended seal typically forms a physical, hermetic seal with the finish of the container. In another embodiment, the extended seal contacts the finish of the container, but does not form a physical, hermetic seal.

The polymeric outer seal 30 depends from the polymeric top wall portion 20 and provides an outer sealing mechanism. The polymeric outer seal 30 is spaced from the interior surface 22*a* of the polymeric annular skirt portion 22.

The closure 10 as shown in FIG. 1A includes a plurality of knurls 38 formed on the polymeric annular skirt portion 22. The plurality of knurls 38 assists the user in gripping the closure during the opening and closing of the closure from the container.

Figure 1B:
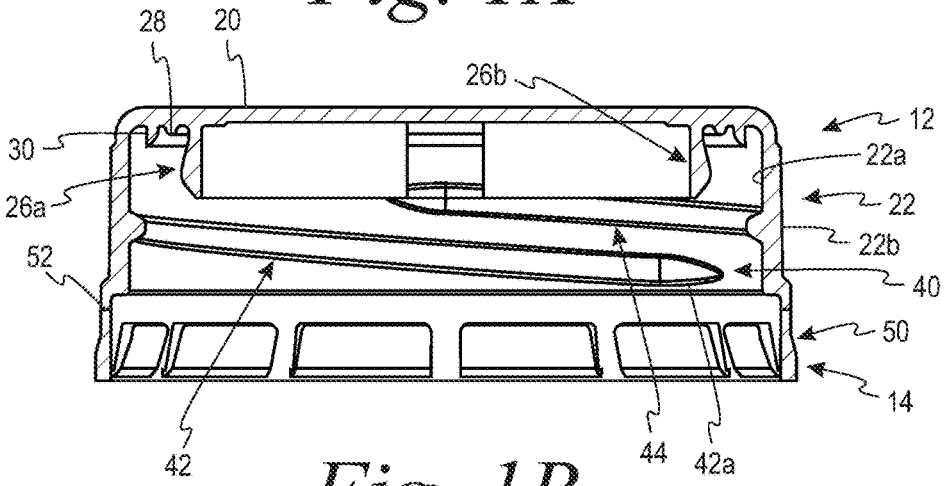
FIG. 1B is a cross-sectional view of the closure taken generally along line 1B-1B of FIG. 1A.
Figure 1C:
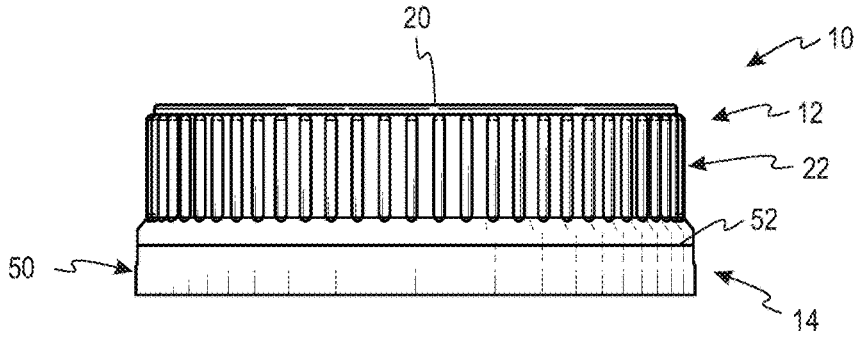
FIG. 1C is a side view of the closure of FIG. 1A.
Figure 1D:
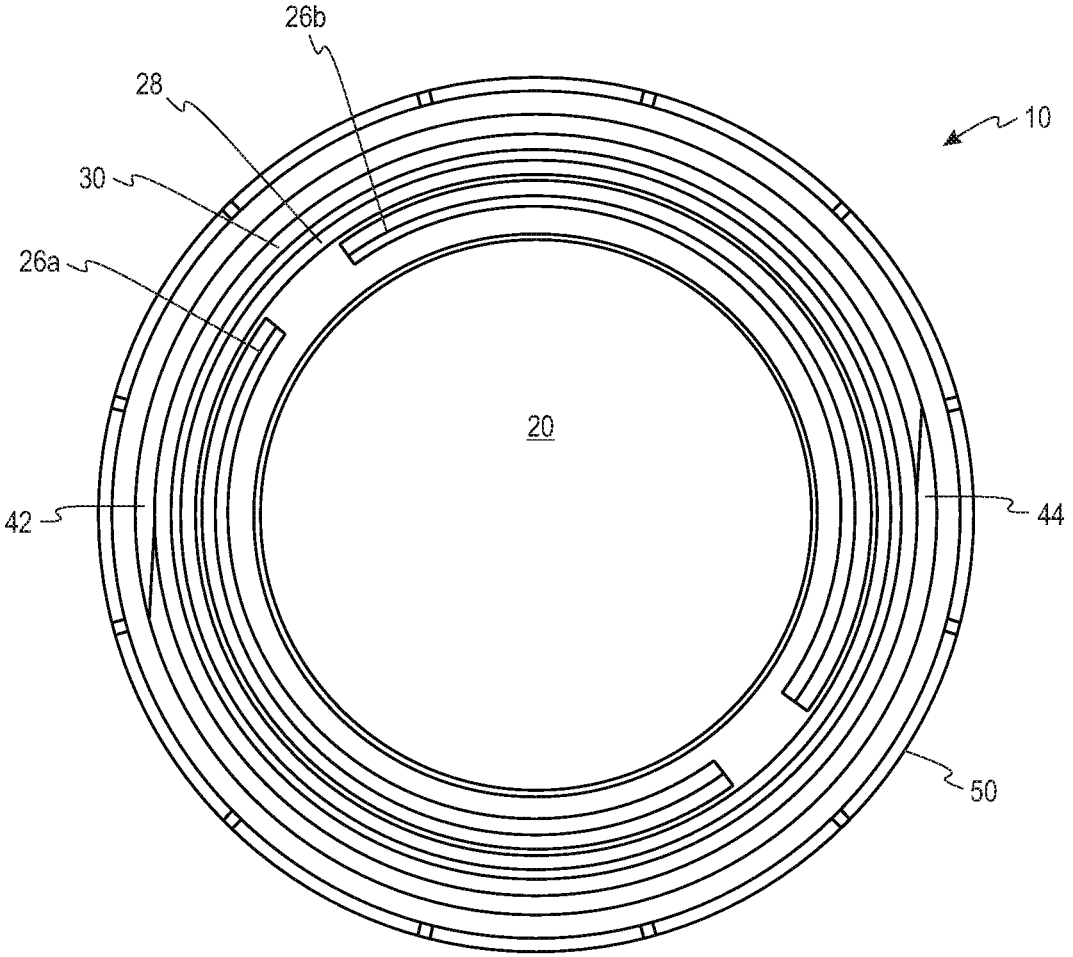
FIG. 1D is a bottom view of the closure of FIG. 1A.

The polymeric annular skirt portion 22 of FIG. 1B includes an internal thread formation 40. The internal thread formation 40 includes a plurality of leads in one embodiment. The internal thread formation 40 is configured for mating engagement with a corresponding external thread formation of a finish or neck portion of a container. The internal thread formation 40 depicted in FIG. 1B includes a first closure lead 42 and a second closure lead 44. It is contemplated that the internal thread formation may be continuous in another embodiment.

The first closure lead 42 begins near the polymeric top wall portion 20 at a first position (not shown in FIG. 1B) and extends in a helical fashion to a second position 42*a* closer to the tamper-evident band 50. Similarly, the second closure lead 44 begins near the polymeric top wall portion 20 at a first position (not shown in FIG. 1B) and extends in a helical fashion to a second position (not shown in FIG. 1B) closer to the tamper-evident band 50. The first and second closure leads 42, 44 are referred collectively as a double lead closure thread. Each of the first and second closure leads 42, 44 is continuous. The first positions of the first and second closure leads 42, 44 are located roughly 180 degrees apart from each other and, thus, begin on generally opposing sides of the closure 10.

It is contemplated that the first and second closure leads may be discontinuous. It is also contemplated that the internal thread formation of the closure may differ from a helical thread formation. It is also contemplated that other internal thread formations may be used in the polymeric closure.

Referring specifically to FIG. 1B, the polymeric tamper-evident band 50 of the polymeric closure 10 is located at the bottom thereof (i.e., an end opposite of the polymeric top wall portion 20). The tamper-evident band 50 depends from and is partially detachably connected to the polymeric annular skirt portion 22 by a frangible connection 52. The tamper-evident band 50 works in conjunction with the container to indicate to a user that the contents of the container may have been accessed. More specifically, the tamper-evident band 50 is designed to partially separate from the polymeric annular skirt portion 22 if a user opens the package and gains access to the container.

The frangible connection 52 may be formed by molded-in-bridges in one embodiment. The molded-in-bridges are typically formed using a feature in the mold. In another embodiment, the polymeric tamper-evident band may be formed using scoring or scored lines, notches, leaders, nicks or other lines of weaknesses.

Figure 2A:
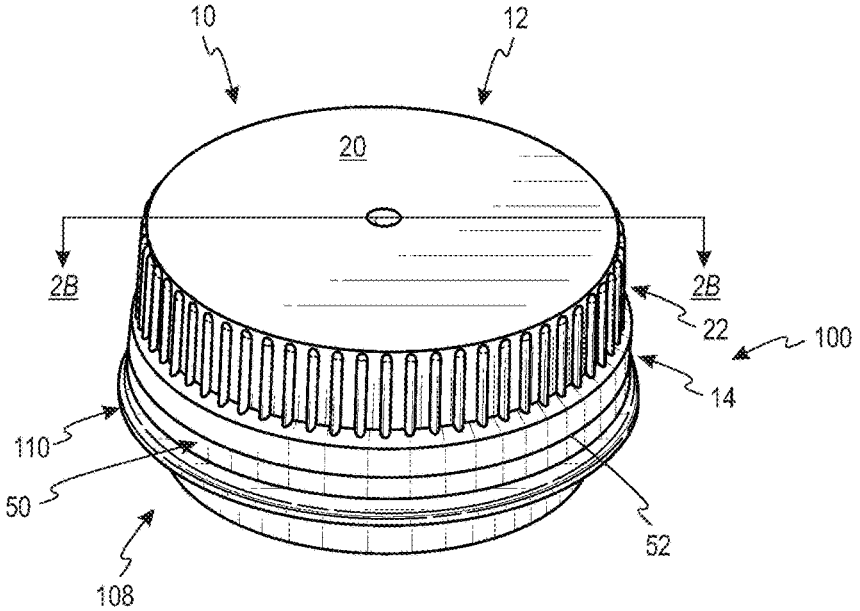
FIG. 2A is a top perspective view of a package including the polymeric closure of FIG. 1A and a container in a closed position according to one embodiment.
Figure 2B:
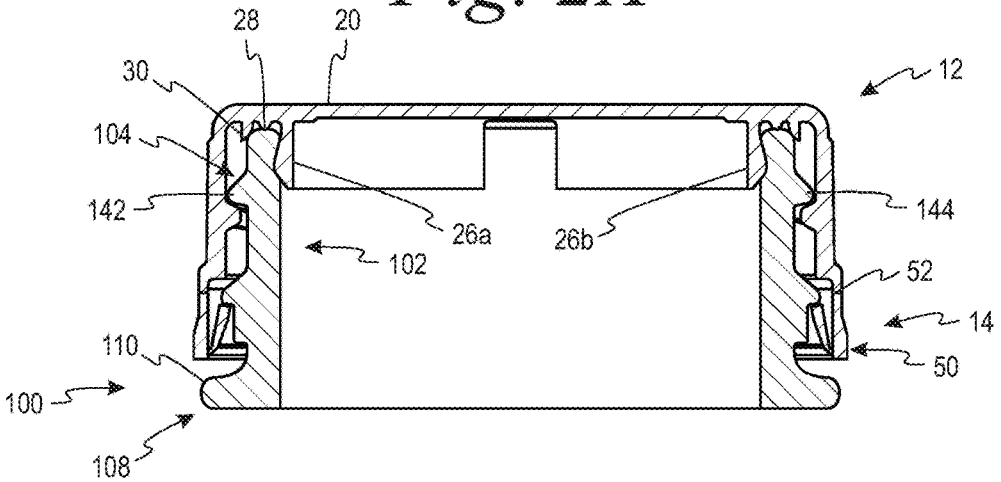
FIG. 2B is a cross-sectional view of the package taken generally along line 2B-2B of FIG. 2A.
Figure 2C:
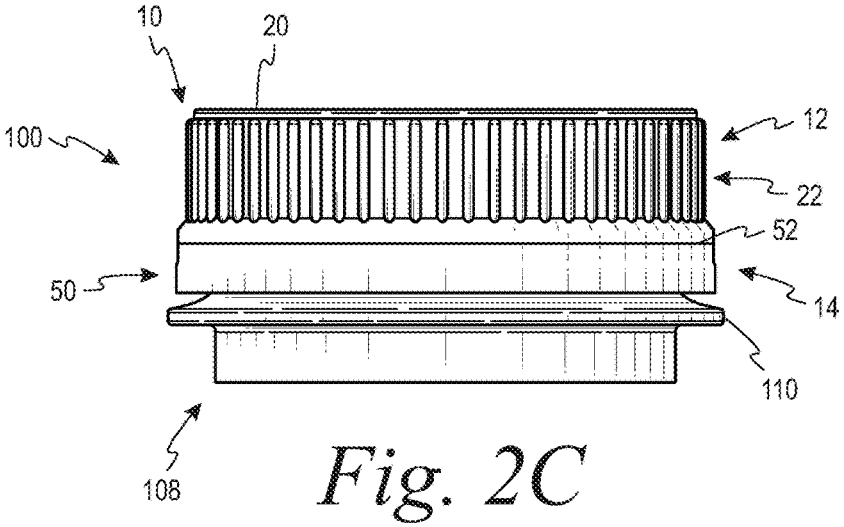
FIG. 2C is a side view of the package of FIG. 2A.

One non-limiting example of a closure and a container forming a package is shown and discussed in conjunction with FIGS. 2A-2C. The polymeric closure 10 may be used with a container 108 used to form a package 100 of FIGS. 2A-2C. It is contemplated that the polymeric closure 10 may be used with other containers to form a package.

A portion of a container 108 is shown in FIGS. 2A-2C and includes a finish or neck portion 102 that defines an opening. The finish or neck portion 102 of the container 108 includes an external thread formation 104 and a continuous outer ring 110. The external thread formation 104 includes a first finish lead 142 and a second finish lead 144 (FIG. 2B). The external thread formation 104 (finish leads 142, 144) engages with the corresponding internal thread formation 40 (closure leads 42, 44) to seal the package 100.

The first finish lead 142 begins near the open end of the container 108 and extends in a helical fashion to a second position that is closer to the closed end of the container. Similarly, the second finish lead 144 starts closer to the open end of the container 108 and extends in a helical fashion to a second position that is closer to the closed end of the container. Each of the first and second finish leads 142, 144 is continuous. The first positions of the first and second finish leads 142, 144 are located roughly 180 degrees apart from each other and, thus, begin on opposing sides of the finish or neck portion 102 of the container 108. When opening the container 108, the first closure lead 42 is desirably in contact with the first finish lead 142 and the second closure lead 44 is desirably in contact with the second finish lead 144. It is contemplated that the external thread formation of the container may have discontinuous leads.

It is contemplated that the external thread formation of the container may be different than that disclosed with respect to container 108.

The continuous outer ring 110 assists in positioning the tamper-evident band 50 when the first closure portion 12 is unthreaded from the finish or neck portion 102 of the container 108 by the breaking of the frangible connection 52.

Figure 3A:
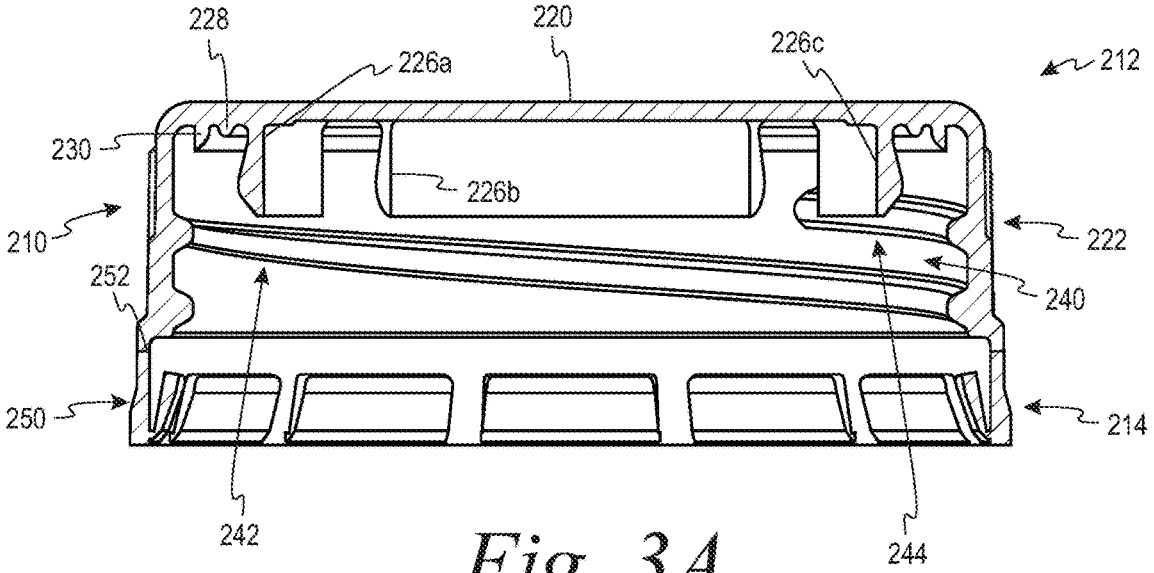
FIG. 3A is a cross-sectional side view of a polymeric closure according to another embodiment.
Figure 3B:
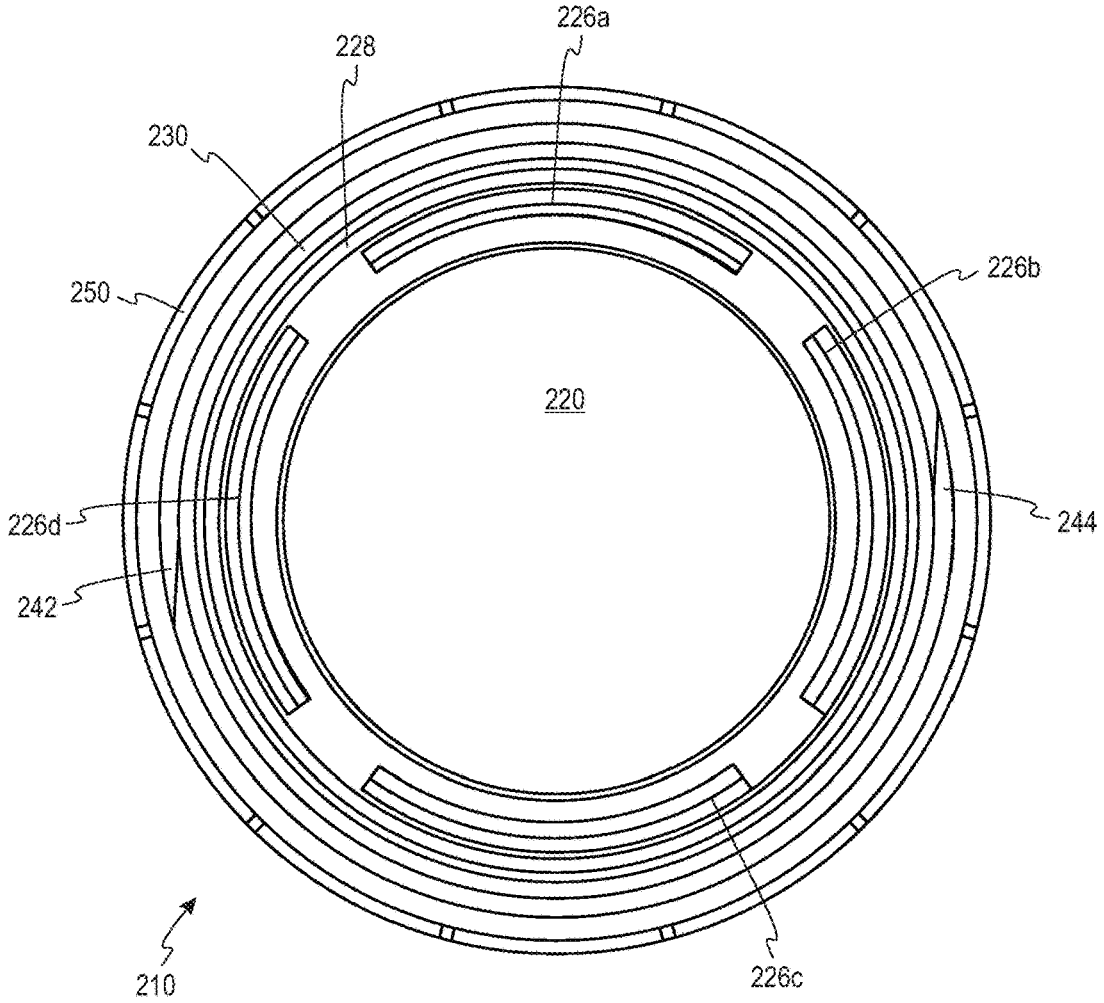
FIG. 3B is a bottom view of the closure of FIG. 3A.

Referring to FIGS. 3A, 3B, additional examples of a polymeric closure with a different number of polymeric plug seals is shown. Referring to FIGS. 3A, 3B, a polymeric closure 210 is shown including a first closure portion 212 and a second closure portion 214. The first closure portion 212 includes a polymeric top wall portion 220, a polymeric annular skirt portion 222 that depends from the polymeric top wall portion 220, a plurality of polymeric plug seals 226*a*-226*d* (FIG. 3B), a polymeric top seal 228, a polymeric outer seal 230, and a thread formation 240 that includes a first lead 242 and a second lead 244. In this embodiment, there are exactly four polymeric plug seals.

Figure 3C:
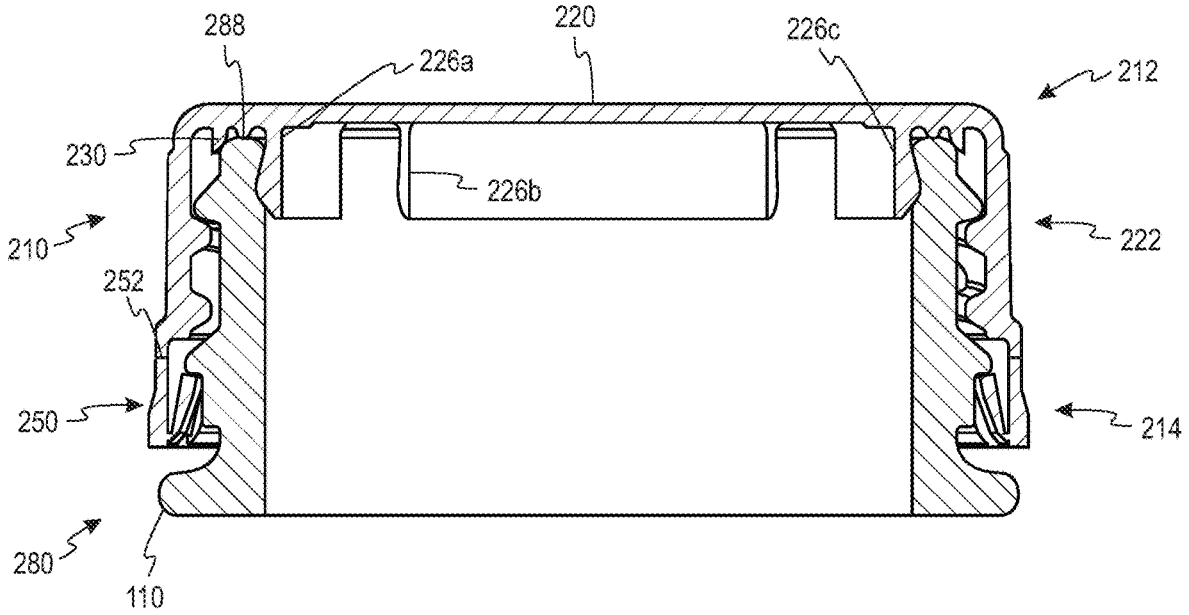
FIG. 3C is a cross-sectional side view of a package including the closure of FIG. 3A and a container in a closed position according to another embodiment.

The second closure portion 214 includes a tamper-evident band 250 and a frangible connection 252. The polymeric closure 210 is identical to the polymeric closure 10 except for the number of polymeric plug seals. The polymeric closure 210 operates in a similar manner as the above discussed polymeric closure 10. Referring to FIG. 3C, the closures of the present invention, including the polymeric closure 210, may be used with the container 108 to form a package 280. It is contemplated that the polymeric closure 210 may be used with other containers to form a package.

Figure 4A:
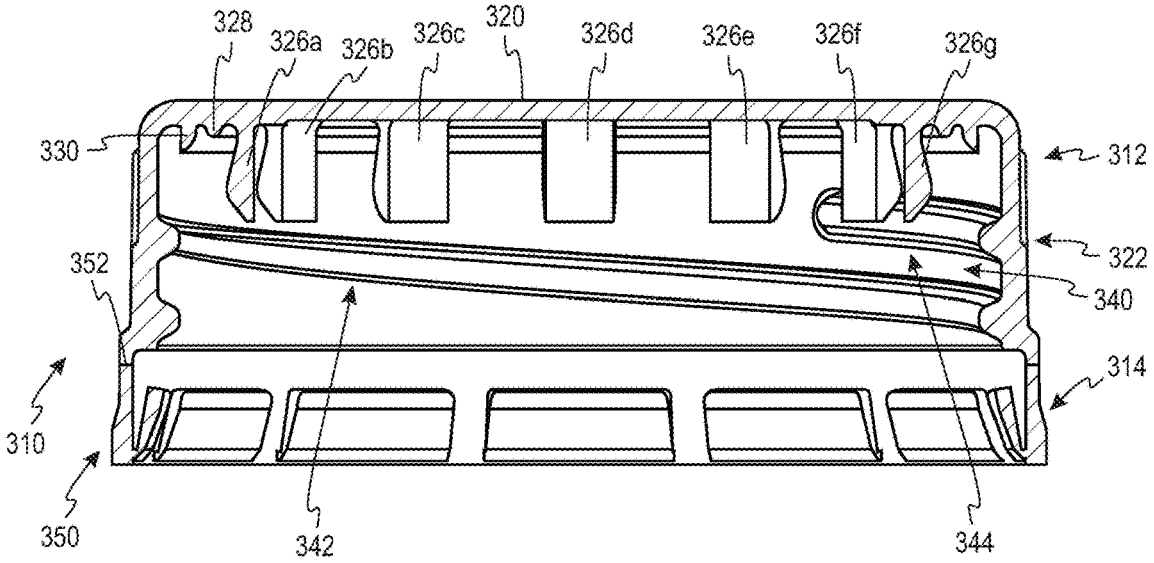
FIG. 4A is a cross-sectional side view of a polymeric closure according to yet another embodiment.
Figure 4B:
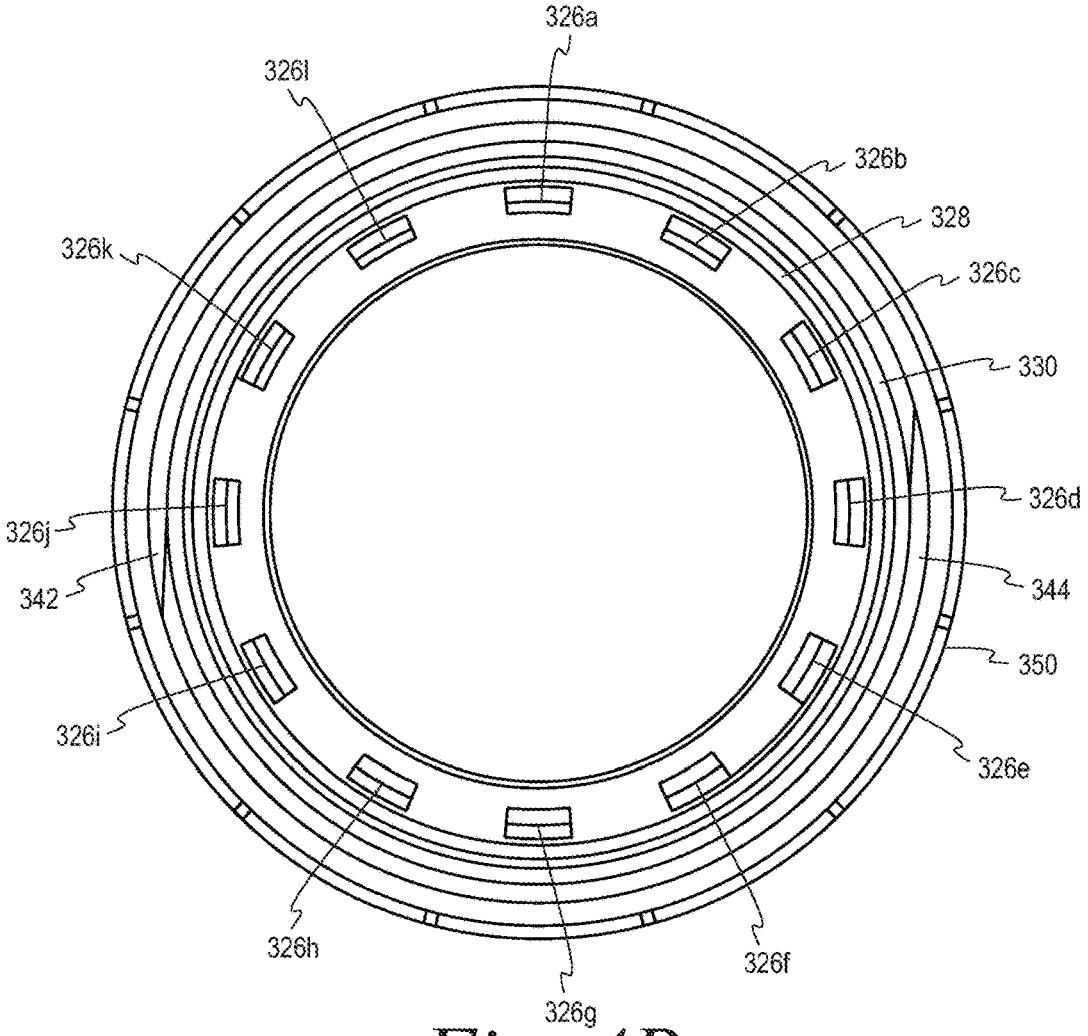
FIG. 4B is a bottom view of the closure of FIG. 4A.
Figure 4C:
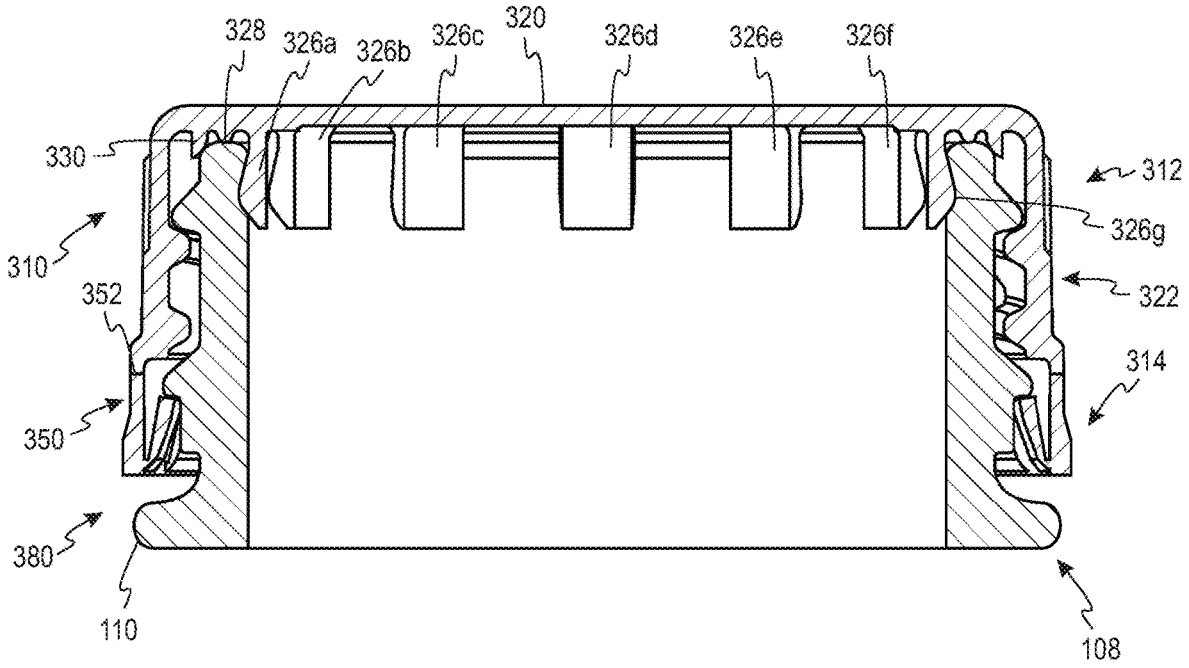
FIG. 4C is a cross-sectional side view of a package including the closure of FIG. 4A and a container in a closed position according to yet another embodiment.

Referring to FIGS. 4A, 4B, a polymeric closure 310 is shown including a first closure portion 312 and a second closure portion 314. The first closure portion 312 includes a polymeric top wall portion 320, a polymeric annular skirt portion 322 that depends from the polymeric top wall portion 320, a plurality of polymeric plug seals 326*a*-326*l* (FIG. 4B), a polymeric top seal 328, a polymeric outer seal 330, and a thread formation 340 that includes a first lead 342 and a second lead 344. In this embodiment, there are exactly twelve polymeric plug seals.

The second closure portion 314 includes a tamper-evident band 350 and a frangible connection 352. The polymeric closure 310 is identical to the polymeric closure 10 except for the number of polymeric plug seals. The polymeric closure 310 operates in a similar manner as the above discussed polymeric closure 10. The polymeric closure 310 may be used with the container 108 to form a package 380 of FIG. 4C. It is contemplated that the polymeric closure 310 may be used with other containers to form a package.

Figure 5:
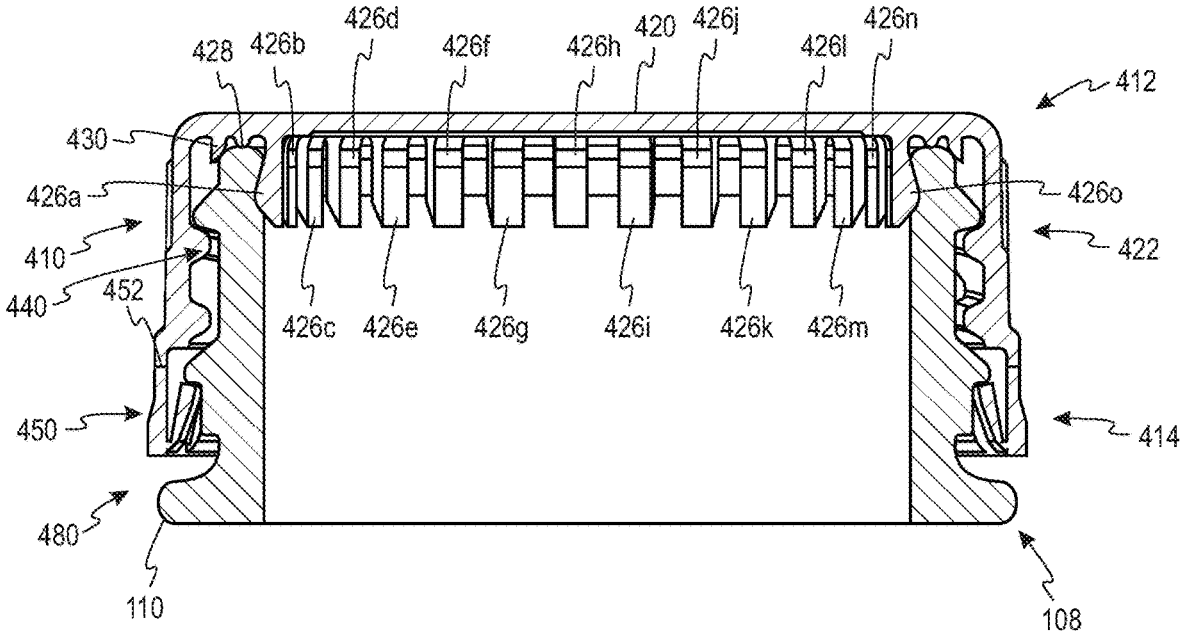
FIG. 5 is a cross-sectional side view of a package including a closure and a container in a closed position according to a further embodiment.

Referring to FIG. 5, a package 480 is shown including a polymeric closure 410 with the container 108 described above. It is contemplated that the polymeric closure 410 may be used with other containers to form a package.

The polymeric closure 410 is shown including a first closure portion 412 and a second closure portion 414. The first closure portion 412 includes a polymeric top wall portion 420, a polymeric annular skirt portion 422 that depends from the polymeric top wall portion 420, a plurality of polymeric plug seals 426*a*-426*o*, a polymeric top seal 428, a polymeric outer seal 430, and a thread formation 440. In this embodiment, there are exactly twenty six polymeric plug seals.

The second closure portion 414 includes a tamper-evident band 450 and a frangible connection 452. The polymeric closure 410 is identical to the polymeric closure 10 except for the number of polymeric plug seals. The polymeric closure 410 operates in a similar manner as the above discussed polymeric closure 10. It is contemplated that the polymeric closure 410 may be used with other containers to form a package.

Figure 6A:
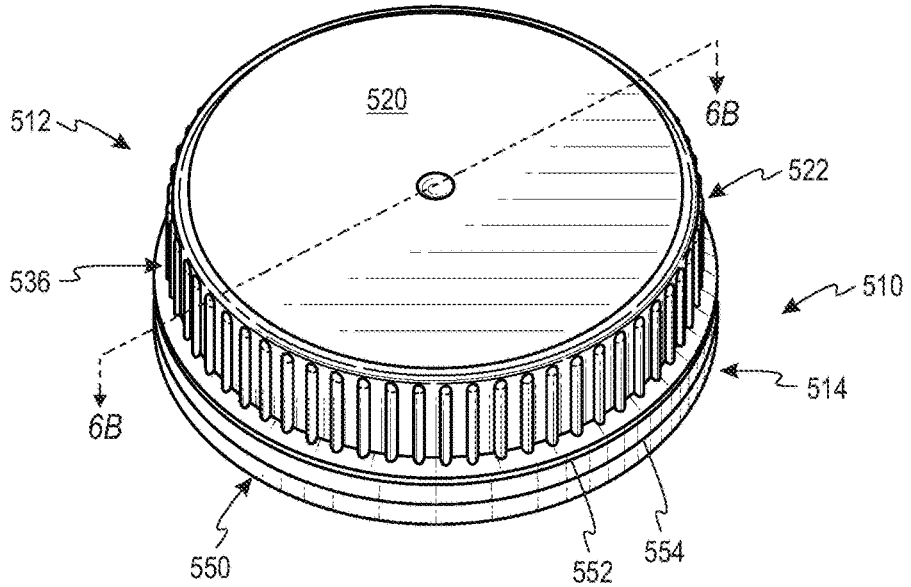
FIG. 6A is a top perspective view of a polymeric closure in a closed position according to one embodiment.

According to another embodiment, a polymeric closure may be formed with a tether. One non-limiting example is shown with a polymeric closure 510 in FIGS. 6A-7. The closure 510 of FIGS. 6A-7 is a one-piece closure and is a generally cylindrical shape. The polymeric closure 510 includes a first closure portion 512 and a second closure portion 514. The first closure portion 512 includes a polymeric top wall portion 520, a polymeric annular skirt portion 522 that depends from the polymeric top wall portion 520, a plurality of polymeric plug seals 526*a*, 526*b*, a polymeric top seal 528, and a polymeric outer seal 530. The second closure portion 514 includes a tamper-evident band 550.

The top wall portion 520 of FIG. 6A extends across the entire top of the closure without any openings in this embodiment.

Figure 6B:
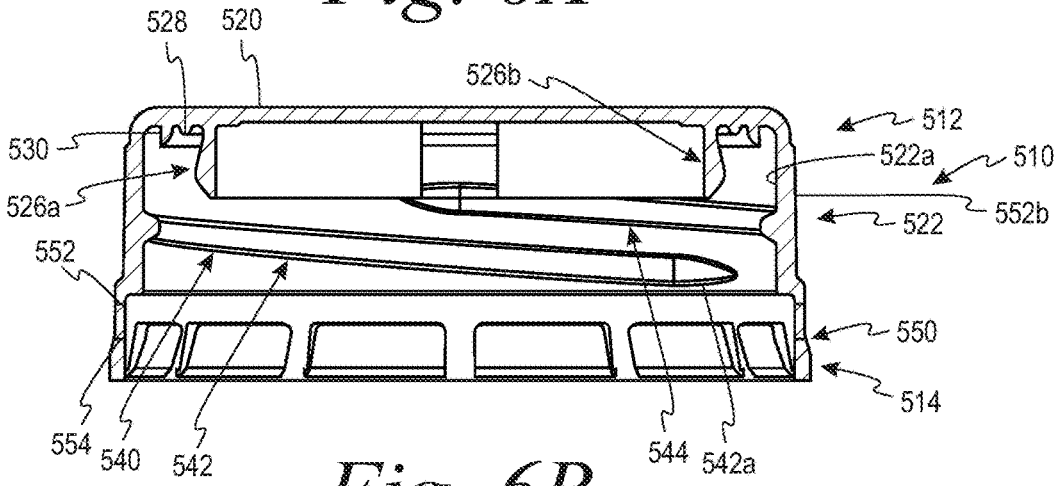
FIG. 6B is a cross-sectional view of the closure taken generally along line 6B-6B in FIG. 6A.
Figure 6C:
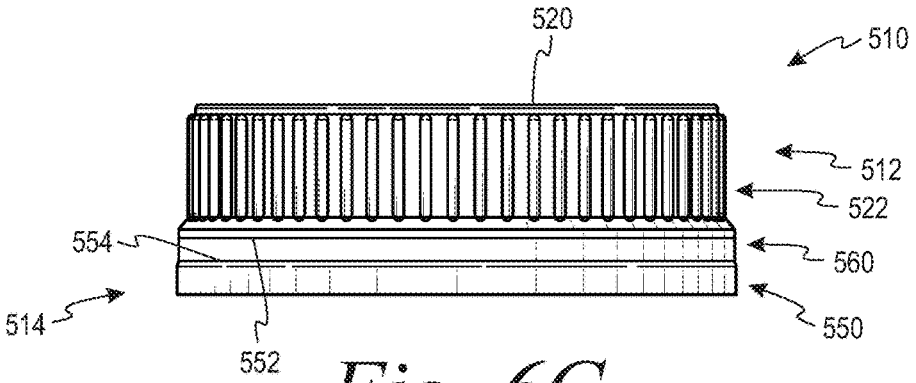
FIG. 6C is a side view of the closure of FIG. 6A.
Figure 6D:
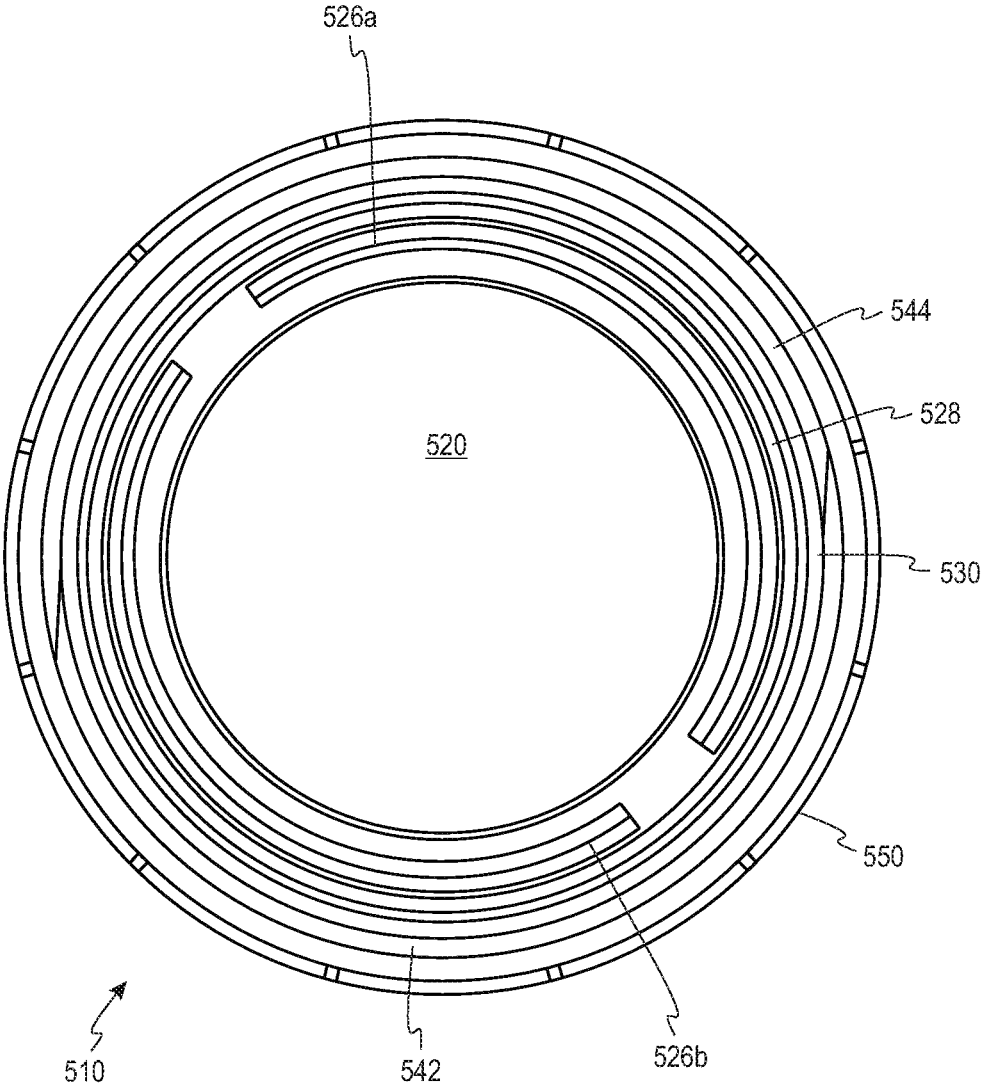
FIG. 6D is a bottom view of the closure of FIG. 6A.
Figure 7:
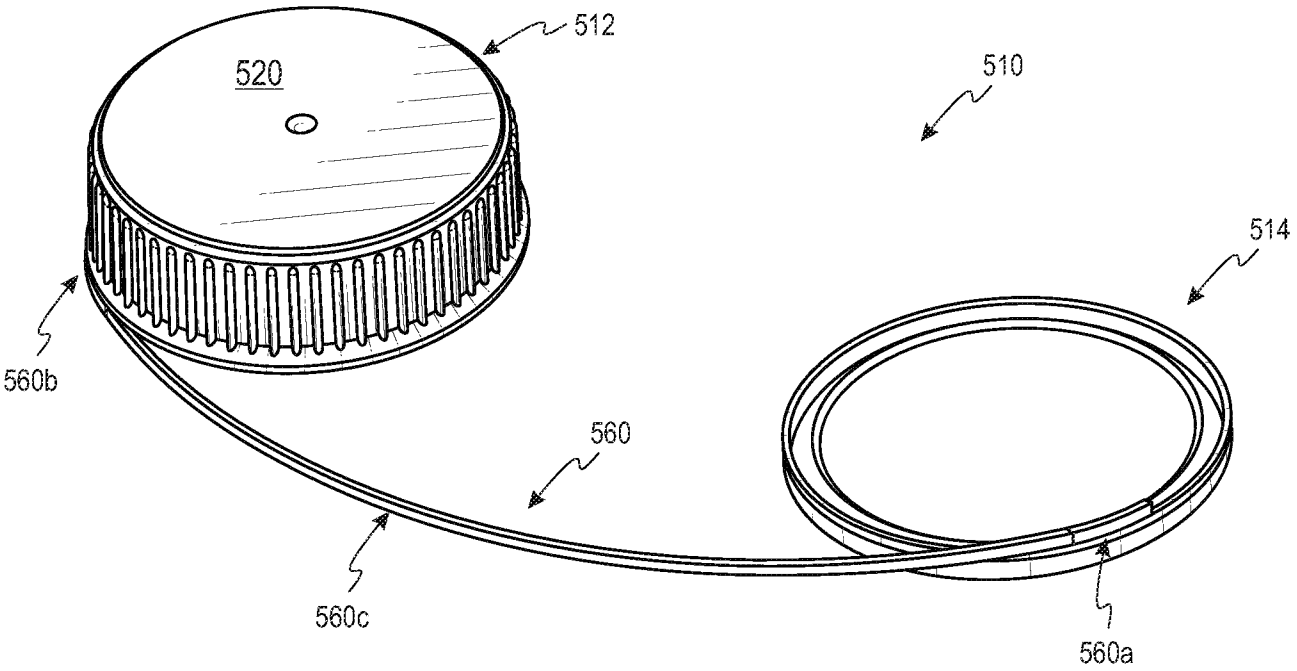
FIG. 7 is a top perspective view of the closure of FIG. 6A in an open position.

The polymeric annular skirt portion 522 of FIG. 6B includes an internal thread formation 540. The polymeric annular skirt portion 522 includes an exterior surface 522*a* and an interior surface 522*b*. The internal thread formation 540 is configured for mating engagement with a corresponding external thread formation of a finish or neck portion of a container. The internal thread formation of the closure may include continuous or discontinuous thread segments, and may include single or multiple leads or threads. Thus, it is contemplated that different thread formations may be used in the closure. One non-limiting example of an internal thread formation is a helical thread formation.

The plurality of polymeric plug seals 526*a*, 526*b* depends from the polymeric top wall portion 520 as shown in FIG. 6B. The plurality of polymeric plug seals 526*a*, 526*b* works in the same manner as the plurality of polymeric plug seals 26*a*, 26*b* discussed above. It is contemplated that the plug seals may be greater in number than shown in this type of closure (tether), such as described in detail above. The polymeric top seal 528 works in the same manner as the polymeric top seal 28 and the polymeric outer seal 530 works in the same manner as the polymeric outer seal 30.

The closure 510 as shown in FIG. 6A includes a plurality of knurls 536 formed on the polymeric annular skirt portion 522. The plurality of knurls 536 assists the user in gripping the closure during the opening and closing of the closure from the container.

Referring specifically to FIG. 6B, the polymeric tamper-evident band 550 of the polymeric closure 510 is located at the bottom thereof (i.e., an end opposite of the polymeric top wall portion 520). The tamper-evident band 550 depends from and is partially detachably connected to the annular skirt portion 522 by a first frangible connection 552. The tamper-evident band 550 works in conjunction with the container to indicate to a user that the contents of the container may have been accessed. More specifically, the tamper-evident band 550 is designed to partially separate from the annular skirt portion 522 if a user opens the package and gains access to the container.

The polymeric annular skirt portion 522 includes a second frangible connection 554 that partially detachably connects to a first section and a second section of the polymeric annular skirt portion 522. The first and second frangible connections 554, 552 may be formed by molded-in-bridges in one embodiment. The molded-in-bridges are typically formed using a feature in the mold. In another embodiment, the polymeric tamper-evident band may be formed using scoring or scored lines, notches, leaders, nicks or other lines of weaknesses.

When the first and second frangible connections 554, 552 are broken, a tether 560 is exposed as shown, for example, in FIG. 7. The tether 560 is attached to a portion of the second closure portion 514 (including the tamper-evident band 550) and a portion of the first closure portion or main body 512 (including the annular skirt portion 522 and the polymeric top wall portion 520). The tether 560 assists in maintaining the polymeric closure 510 as a one-piece assembly after the first and second frangible connections 554, 552 have been broken.

As shown in FIG. 7, the tether 560 includes attached portions 560*a*, 560*b* and also includes an unattached portion 560*c* that is located between the attached portions 560*a*, 560*b*. When the internal thread formation of the first closure portion is not in mating engagement with the external thread formation of the container, the first closure portion 512 is adapted to be spaced away from the second closure portion 514 via the unattached tether portion 560*c*. One non-limiting example of the same is shown in FIG. 7 with only the closure 510. The length of the attached and unattached portions of the tether may vary from that shown in FIG. 7.

The tether 560 is of a length that assists in spacing apart the first closure portion 512 from the second closure portion 514. To assist in eliminating or reducing the chances of the first closure portion 512 from interfering with a user while, for example, drinking the contents of a container, the unattached portion 560*c* of the tether 560 extends greater than about 300 degrees around the circumference of the closure in one embodiment. By having the unattached portion of the tether extending greater than about 300 degrees around the circumference of the closure, the distance of the first closure portion 512 from the finish or neck portion of the container is increased. In other embodiments, the unattached portion of the tether desirably extends greater than about 320 or about 330 degrees around the circumference of the closure. In a further embodiment, the unattached portion of the tether extends greater than about 340 degrees around the circumference of the closure.

The polymeric closure 510 may also include a polymeric tamper-evident feature. For example, the closure 510 includes a polymeric tamper-evident band 550 located at the bottom thereof (i.e., an end opposite of the polymeric top wall portion 520). The tamper-evident band 550 depends from and is at least partially detachably connected to the polymeric annular skirt portion 522 by the frangible connection 552. The tamper-evident band 550 works in conjunction with the container to indicate to a user that the contents of the container may have been accessed.

Figure 8A:
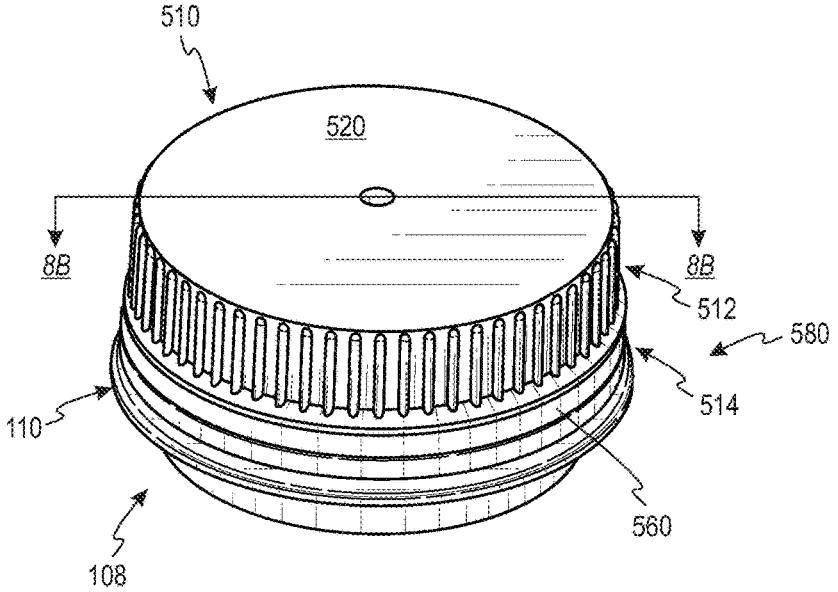
FIG. 8A is a top perspective view of a package including the polymeric closure of FIG. 6A and a container in a closed position according to one embodiment.
Figure 8B:
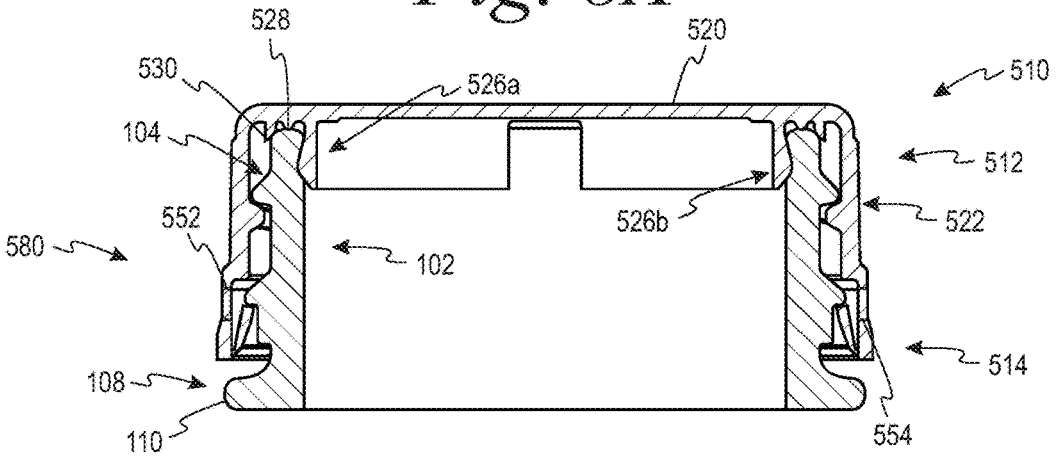
FIG. 8B is a cross-sectional view of the package taken generally along line 8B-8B in FIG. 8A.
Figure 8C:
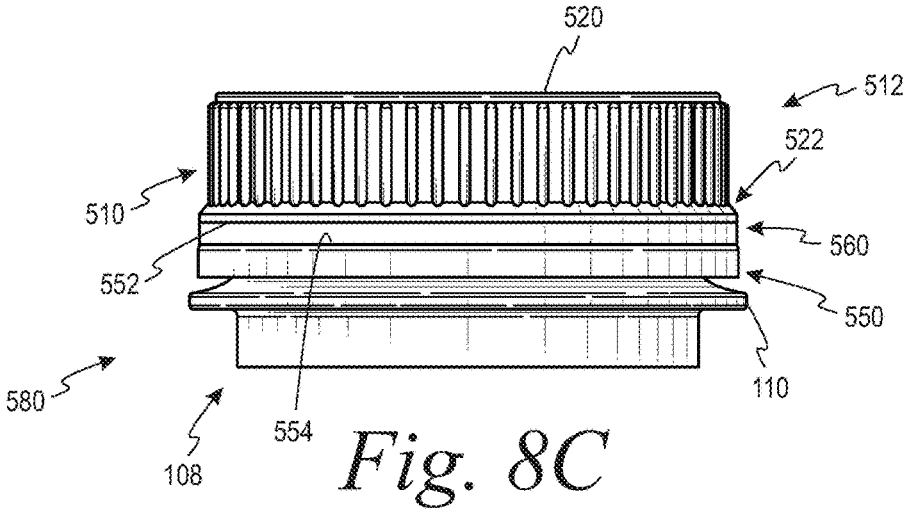
FIG. 8C is a side view of the package of FIG. 8A.

The polymeric closure 510, may be used with the container 108 to form a package 580 of FIGS. 8A-8C. It is contemplated that the closure 510 may be used with other containers to form a package. A portion of the container 108 is shown in FIGS. 8A-8C and includes the finish or neck portion 102 that defines an opening. The finish or neck portion 102 of the container 108 includes an external thread formation 104. The external thread formation 104 of the container 108 engages with the corresponding internal thread formation 540 of the closure 510 to seal the package 508. The external thread formation of the container may include continuous or discontinuous thread segments, and may include single or multiple threads as discussed above. One non-limiting example of an external thread formation of the container is a helical thread formation.

Figure 9A:
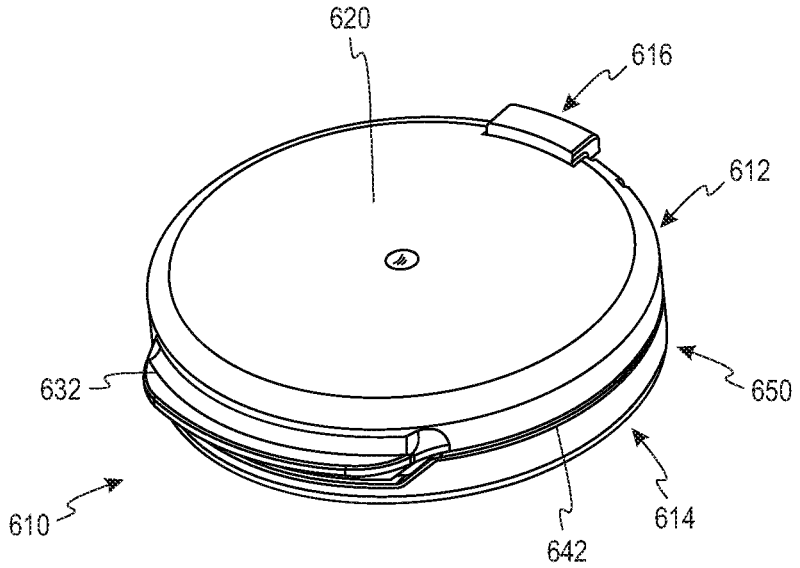
FIG. 9A is a top perspective view of a flip-top polymeric closure in a closed position according to one embodiment.
Figure 9B:
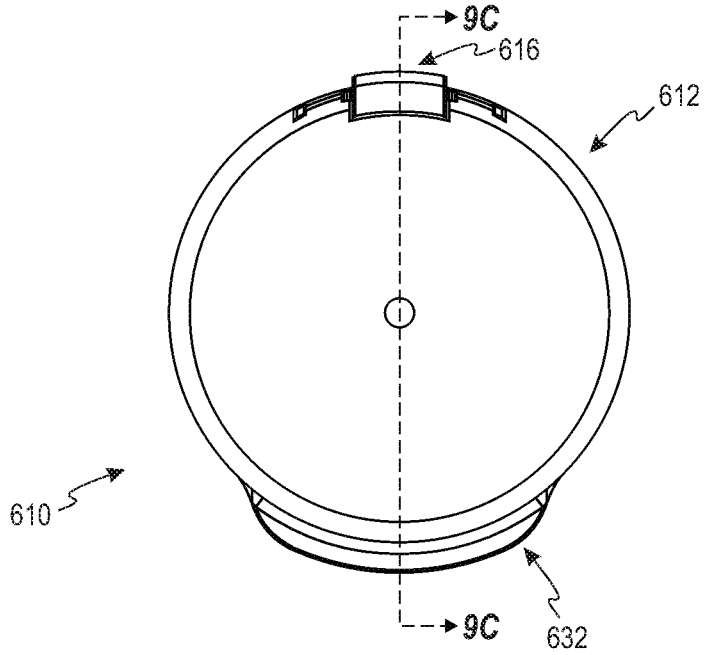
FIG. 9B is a top view of the flip-top closure of FIG. 9A.
Figure 9C:
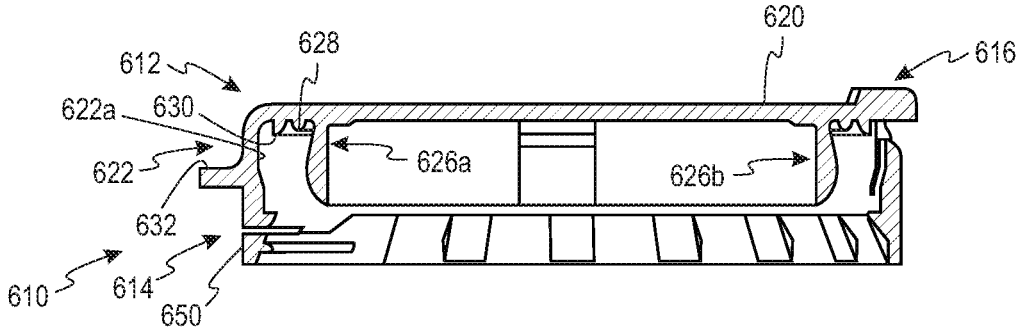
FIG. 9C is a cross-sectional view of the closure taken generally along line 9C-9C in FIG. 9B.

According to another embodiment, a flip-top polymeric closure 610 may be used in a further embodiment. Referring to FIGS. 9A-9C, the flip-top closure 610 is shown. The flip-top closure 610 is configured to assist in keeping it with the container so as to reduce environmental waste, while still providing a desirable tamper-evident feature and maintaining the closure in an open position when accessing the contents of the container.

Referring still to FIGS. 9A-9C, the flip-top polymeric closure 610 includes a first closure portion or lid 612 and a second closure portion or base 614. The flip-top closure 610 is a one-piece closure. The first closure portion 612 and the second closure portion 614 are connected via a hinge 616. As shown best in FIG. 9C, the first closure portion 612 includes a polymeric top wall portion 620, a polymeric annular skirt portion 622, a plurality of polymeric plug seals 626*a*, 626*b*, a polymeric top stop 628, a polymeric outer seal 630, and a prying tab 632. It is contemplated that the plug seals may be greater in number than shown in flip-top closures, such as described in detail above. The second closure portion 614 includes a polymeric tamper-evident band 650.

As shown in FIG. 9C, the plurality of polymeric plug seals 626*a*, 626*b* depends from the polymeric top wall portion 620 and provides an inner sealing mechanism. The plurality of plug seals 626*a*, 626*b* is spaced from an interior surface 622*a* of the polymeric annular skirt portion 622 when the flip-top closure 610 is in a closed position. The polymeric top seal 628 is spaced from the interior surface 622*a* of the polymeric annular skirt portion 622 when the flip-top closure 610 is in a closed position as shown in FIG. 9C. The polymeric outer seal 630 is spaced from the interior surface 622*a* of the polymeric annular skirt portion 622 when the flip-top closure 610 is in a closed position as shown in FIG. 9C. The polymeric top seal 628 and the polymeric outer seal 630 function in the same manner respectively as the polymeric top seal 28 and the polymeric outer seal 30.

Referring back to FIGS. 9A-9C, the polymeric tamper-evident band 650 of the closure 610 is located at the bottom thereof (i.e., an end opposite of the polymeric top wall portion 620). The tamper-evident band 650 works in conjunction with the container to indicate to a user that the contents of the container may have been accessed. More specifically, the tamper-evident band 650 is designed to partially separate from the annular skirt portion 622 if a user opens the package by flipping the flip-top closure via the hinge 616.

The first closure portion 612 and the second closure portion 614 are attached by the hinge 616. The hinge 616 assists in moving the flip-top closure 610 between an open position and a closed position. The hinge 616 is shown in FIGS. 9A-9C in the closed position. It is most desirable for the hinge 616 to flip or rotate at least about 200 or about 215 degrees or even more desirably at least about 225 or about 235 degrees from a closed position to an open position. The hinge 616 may flip or rotate up to about 215 or about 225 degrees. It is desirable for the hinge 616 to flip or rotate up to about 235 degrees. The hinge 616 typically flips or rotates from about 190 to about 235 degrees and, more specifically, from about 190 to about 225 degrees.

Figure 10:
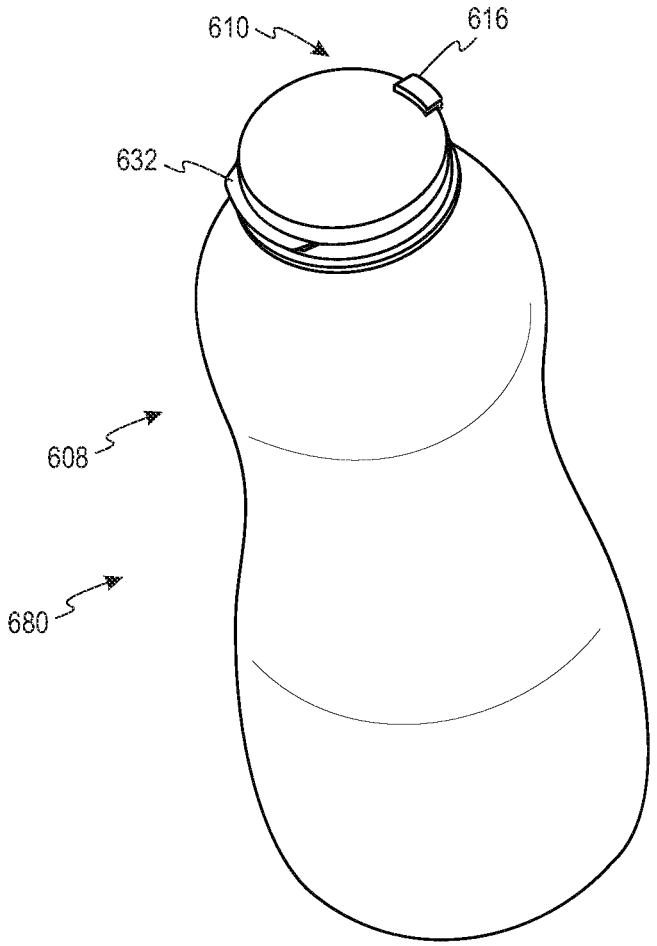
FIG. 10 is a top perspective view of a package including the flip-top closure of FIG. 9A and a container in a closed position according to one embodiment.

One non-limiting example of a flip-top closure and a container forming a package is shown and discussed in conjunction with FIG. 10. The closure 610 may be used with a container 608 used to form a package 680 of FIG. 10. The container 608 includes a finish or neck portion that defines an opening. It is contemplated that the closure 610 may be used with other containers.

Figure 11A:
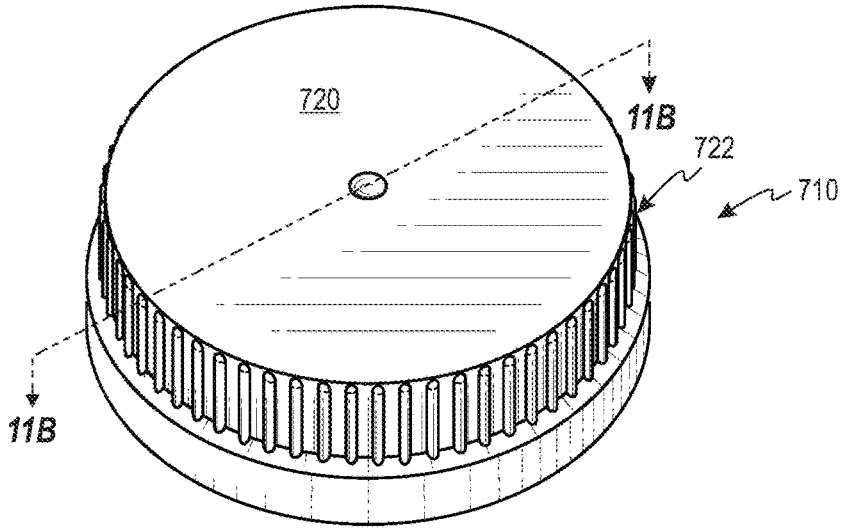
FIG. 11A is a top perspective view of a polymeric closure according to a further embodiment.
Figure 11B:
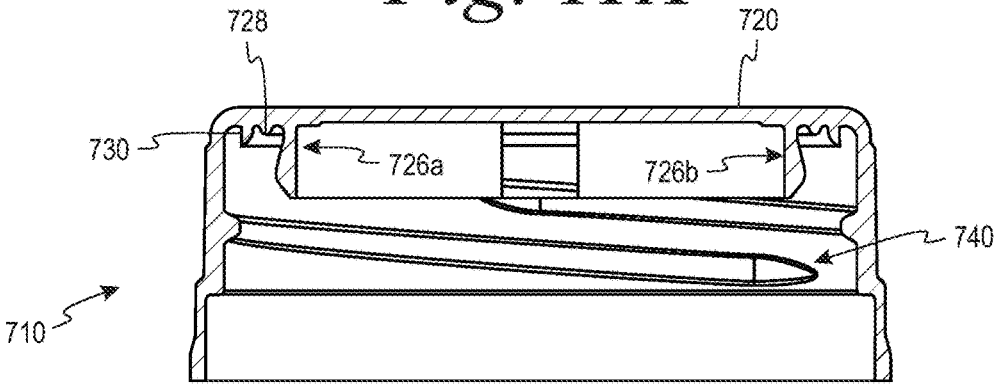
FIG. 11B is a cross-sectional view of the closure taken generally along line 11B-11B of FIG. 11A.
Figure 11C:
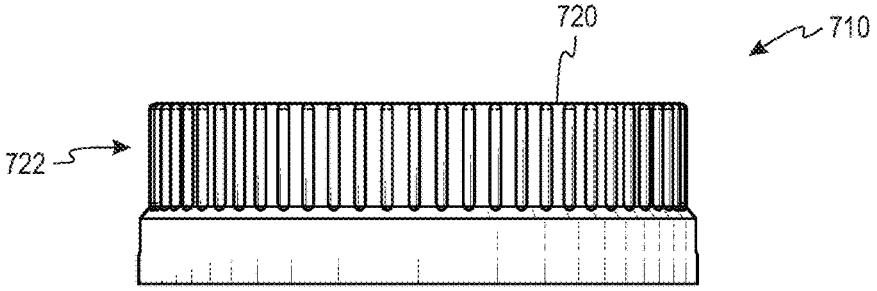
FIG. 11C is a side view of the closure of FIG. 11A.

In another embodiment, the polymeric closure may be a closure without a tamper-evident feature. For example, referring to FIGS. 11A-11C, a polymeric closure 710 is shown. The polymeric closure 710 includes a polymeric top wall portion 720, a polymeric annular skirt portion 722 that depends from the polymeric top wall portion 720, and a plurality of polymeric plug seals 726*a*, 726*b* (FIG. 11B). It is contemplated that the plug seals may be greater in number than shown in this type of closure without a temper-evident feature, such as described in detail above. The polymeric annular skirt portion 722 includes an internal thread formation 740. The plurality of polymeric plug seals 726*a*, 726*b* and the internal thread formation 640 function the same as the plurality of polymeric plug seals 26*a*, 26*b* and the internal thread formation 40 discussed above. The polymeric closure 710 may be used with a container (e.g., container 108) to form a package.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

The closures are typically formed by processes such as injection or compression molding, extrusion or the combination thereof.

The containers described above are typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container typically has an encapsulated oxygen-barrier layer or oxygen barrier material incorporated therein.

To open the container and gain access to the product therein, a polymeric closure with an internal thread formation is unthreaded by turning the closure with respect to the container in one embodiment. To open the container and gain access to the product therein, a flip top polymeric closure is flipped and rotated via the hinge such that the first and second closure portions are opened with respect to each other.

The polymeric closures are especially desirable in high-temperature applications. The polymeric closures may be exposed to high-temperature applications such as hot-fill, hot-fill with pasteurization, and retort applications. Hot-fill refers to a process of filling packaging with heated, commercially sterile product. During the hot-fill process, the product is held for a predetermined time and temperature to sterilize it before it is filled into the container. A hot-fill application is performed at temperatures above about 150° F. and is generally from about 150° F. to about 200° F. A hot-fill application with pasteurization is generally performed at temperatures from about 180° F. to about 230° F. Retort applications generally heat up a product (e.g., liquid) within the container to temperatures from about 200° F. to about 270° F. It is contemplated that the polymeric closures of the present invention may be used in other high-temperature applications.

The polymeric closures are also desirable with container finishes having a thinner wall size (e.g., thickness less than about 0.06 inches). The polymeric closures are desirable because the space or spaces between adjacent polymeric plug seals allows the wall of the container finish to obtain heat in a quicker and more efficient fashion. By having the container finish heated quicker allows the thinner wall size to support an outer seal without deflecting from the outer seal during the sterilization process. This allows an outer seal of the polymeric closure to remain desirably sealed with the thinner wall sizes of the container finish during the sterilization process.

According to a method of the present disclosure, a package is formed that includes providing a container having a finish defining an opening. The container has an external thread formation on the finish. A polymeric closure is provided that is configured for fitment to the finish of the container for closing the opening of the container. The polymeric closure comprises a first closure portion including a top wall portion and an annular skirt portion. The top wall portion includes a plurality of polymeric plug seals extending downwardly therefrom. The plurality of polymeric plug seals extends around a circumference of the polymeric closure with a respective space located between each of the adjacent polymeric plug seals. The annular skirt portion depends from the top wall portion. The annular skirt portion has an interior surface. The interior surface of the annular skirt portion includes an internal thread formation for mating engagement with the external thread formation of the container. Product is filled into the container in which the product is greater than 150° F. The plurality of polymeric plug seals is placed and spaced from the interior surface of the annular skirt portion and assists in sealing with the container. The plurality of polymeric plug seals provides a seal with the finish of the container across at least 40 to about 90 percent of the finish.

In one method, the product is heated to greater between about 150° F. and 200° F. In one method, the product is hot filled at a temperature greater than about 150° F., and desirably between about 150° F. to about 200° F. The plurality of polymeric plug seals may be as discussed such as, for example, from 4 to about 50 plugs. The plurality of polymeric plug seals provides a seal with a finish of a container across at least 50 to about 90 percent of the finish in one method. It is contemplated that other the finish of a container may be from about 60 to about 90 percent, or from about 60 to about 80 percent.

It is contemplated that the polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures of the present invention.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present invention have been described above, it should be understood that they have been presented by way of example only, and not limitation. Numerous changes to the disclosed embodiments can be made in accordance with the disclosure herein, without departing from the spirit or scope of the invention. Thus, the breadth and scope of the present invention should not be limited by any of the above described embodiments. Rather, the scope of the invention should be defined in accordance with the following claims and their equivalents.

What is claimed is:

1. A polymeric closure comprising:

a first closure portion including:

a top wall portion including a plurality of polymeric plug seals extending downwardly therefrom, the plurality of polymeric plug seals extending around a circumference of the polymeric closure with a respective space located between each of the adjacent polymeric plug seals, the respective space extending from the top wall portion to an interior of the first closure portion such that each of the plurality of polymeric plug seals is discrete and separate from the remaining ones of the plurality of plug seals; and an annular skirt portion depending from the top wall portion, the annular skirt portion having an interior surface, the interior surface of the annular skirt portion including an internal thread formation for mating engagement with an external thread formation of a container, and wherein the plurality of polymeric plug seals is spaced from the interior surface of the annular skirt portion and assists in sealing with the container, wherein the plurality of polymeric plug seals provides a seal with a finish of the container across at least 40 to about 90 percent of the finish.

2. The polymeric closure of claim 1, wherein the plurality of polymeric plug seals is from 4 to about 50 plugs.

3. The polymeric closure of claim 2, wherein the plurality of polymeric plug seals is from about 10 to about 40 plugs.

4. The polymeric closure of claim 3, wherein the plurality of polymeric plug seals is from about 15 to about 30 plugs.

5. The polymeric closure of claim 1, wherein the plurality of polymeric plug seals is at least 10 plugs.

6. The polymeric closure of claim 1, wherein the plurality of polymeric plug seals provides a seal with a finish of a container across at least 50 to about 90 percent of the finish.

7. The polymeric closure of claim 6, wherein the plurality of polymeric plug seals provides a seal with a finish of a container across at least 60 to about 80 percent of the finish.

8. The polymeric closure of claim 1, further including a second closure portion including a tamper-evident band depending from and being partially detachably connected to the annular skirt portion by a first frangible connection.

9. The polymeric closure of claim 8, wherein the annular skirt portion further includes a second frangible connection that partially detachably connects to a first section and a second section of the annular skirt portion, and wherein a tether is exposed when the first and second frangible connections are broken.

10. The polymeric closure of claim 1, wherein the polymeric closure is a flip-top closure, the flip-top closure further including a hinge.

11. The polymeric closure of claim 1, wherein the top wall portion further includes an outer seal.

12. The polymeric closure of claim 1, wherein the polymeric closure is a one-piece closure.

13. A package comprising:

a container having a finish defining an opening, the container having an external thread formation on the finish; and a polymeric closure being configured for fitment to the finish of the container for closing the opening of the container, the polymeric closure comprising a first closure portion including a top wall portion and an annular skirt portion, the top wall portion including a plurality of polymeric plug seals extending downwardly therefrom, the plurality of polymeric plug seals extending around a circumference of the polymeric closure with a respective space located between each of the adjacent polymeric plug seals, the respective space extending from the top wall portion to an interior of the first closure portion such that each of the plurality of polymeric plug seals is discrete and separate from the remaining ones of the plurality of plug seals, the annular skirt portion depending from the top wall portion, the annular skirt portion having an interior surface, the interior surface of the annular skirt portion including an internal thread formation for mating engagement with the external thread formation of the container, wherein the plurality of polymeric plug seals is spaced from the interior surface of the annular skirt portion and assists in sealing with the container, wherein the plurality of polymeric plug seals provides a seal with the finish of the container across at least 40 to about 90 percent of the finish.

14. The package of claim 13, wherein the plurality of polymeric plug seals is from 4 to about 50 plugs.

15. The package of claim 13, wherein the plurality of polymeric plug seals is from about 10 to about 40 plugs.

16. The package of claim 13, wherein the plurality of polymeric plug seals provides a seal with a finish of a container across at least 50 to about 90 percent of the finish.

17. The package of claim 16, wherein the plurality of polymeric plug seals provides a seal with a finish of a container across at least 60 to about 80 percent of the finish.

18. The package of claim 13, further including a second closure portion including a tamper-evident band depending from and being partially detachably connected to the annular skirt portion by a first frangible connection, the annular skirt portion further including a second frangible connection that partially detachably connects to a first section and a second section of the annular skirt portion, and wherein a tether is exposed when the first and second frangible connections are broken.

19. The package of claim 13, wherein the polymeric closure is a flip-top closure, the flip-top closure further including a hinge.

20. The package of claim 13, wherein the top wall portion further includes an outer seal.

21. The package of claim 13, wherein the finish of the container has a thickness less than about 0.06 inches.

22. A method of forming a package, the method comprising:

providing a container having a finish defining an opening, the container having an external thread formation on the finish; and providing a polymeric closure being configured for fitment to the finish of the container for closing the opening of the container, the polymeric closure comprising a first closure portion including a top wall portion and an annular skirt portion, the top wall portion including a plurality of polymeric plug seals extending downwardly therefrom, the plurality of polymeric plug seals extending around a circumference of the polymeric closure with a respective space located between each of the adjacent polymeric plug seals, the respective space extending from the top wall portion to an interior of the first closure portion such that each of the plurality of polymeric plug seals is discrete and separate from the remaining ones of the plurality of plug seals, the annular skirt portion depending from the top wall portion, the annular skirt portion having an interior surface, the interior surface of the annular skirt portion including an internal thread formation for mating engagement with the external thread formation of the container; and filling product into the container, the product being greater than 150° F., wherein the plurality of polymeric plug seals is spaced from the interior surface of the annular skirt portion and assist in sealing with the container, wherein the plurality of polymeric plug seals provides a seal with the finish of the container across at least 40 to about 90 percent of the finish.

23. The method of claim 22, wherein the product is heated to greater than about 150° F.

24. The method of claim 23, wherein the product is heated to greater than about 200° F.

25. The method of claim 23, wherein the product is hot filled at a temperature greater than about 150° F.

26. The method of claim 23, wherein the plurality of polymeric plug seals is from 4 to about 50 plugs.

27. The method of claim 23, wherein the plurality of polymeric plug seals provides a seal with a finish of a container across at least 50 to about 80 percent of the finish.

* * * * *